United States Patent [19]

Adolfson

[11] 4,159,182

[45] Jun. 26, 1979

[54] COMBINATION TOOTHPICK AND BEVERAGE STIRRER

[75] Inventor: George S. Adolfson, Largo, Fla.

[73] Assignee: Catherine E. Buck, Van Horn, Tex.

[21] Appl. No.: 852,804

[22] Filed: Nov. 18, 1977

[51] Int. Cl.[2] ..... A47J 43/28

[52] U.S. Cl. ..... 366/343; 30/150; 30/324

[58] Field of Search ..... 366/343, 349; 30/141, 30/142, 147–150, 323, 324; 425/DIG. 109; 132/89–93; 128/62 A; 206/368, 369

[56] References Cited

U.S. PATENT DOCUMENTS

| | | | |
|---|---|---|---|
| 2,704,267 | 3/1955 | Tilden, Jr. | 425/DIG. 109 |
| 2,877,547 | 3/1959 | Feaster | 30/322 X |
| 3,563,253 | 2/1971 | Barman | 132/89 |
| 3,590,814 | 7/1971 | Bennett et al. | 128/62 A |
| 3,664,020 | 5/1972 | Hammond et al. | 132/90 |
| 3,978,872 | 9/1976 | Bond | 132/89 |

FOREIGN PATENT DOCUMENTS

| | | | |
|---|---|---|---|
| 38380 | 6/1913 | Sweden | 132/89 |

*Primary Examiner*—Leonard D. Christian

[57] ABSTRACT

An improved frangible beverage stirrer is disclosed which is capable of being broken into two toothpicks. The utensil includes a handle portion having an upper surface and a lower surface with a relatively long dimension along an axis. A first end of the handle has a gripping surface and a second end of the handle opposite thereto has a spoon bowl or other appliance mounted thereon. The handle portion has a first straight diagonal groove in the upper surface thereof located between the first and second end and oriented at an angle with respect to the axis. A second straight diagonal groove parallel to and juxtaposed with the first groove, is in the lower surface of the handle. The handle is capable of being broken into two portions along the grooves by grasping the gripping surface and the spoon bowl and applying a torque along the axis, thereby forming two toothpicks with their respective pointed ends formed by the grooves.

3 Claims, 4 Drawing Figures

COMBINATION TOOTHPICK AND BEVERAGE STIRRER

FIELD OF THE INVENTION

The invention disclosed generally relates to beverage stirring or eating utensils and more particularly relates to frangible beverage stirring utensils.

BACKGROUND OF THE INVENTION

Disposable eating utensils and beverage stirrers have come into popular use for parties, picnics, and at fast service eating establishments. Plastic beverage stirrers in the form of a long handled spoon are distributed at fast service eating establishments for use in stirring coffee or other beverages. Such spoons are designed with a relatively small bowl portion suitable for stirring the beverage but, because of its small size, which is on the order of ½ inch in diameter, it is too small for conventional eating purposes. Where toothpicks are desired by the customer at such an establishment, separate toothpicks must be provided.

Relatively larger eating utensils have been made in the prior art which include a perforated portion which can be broken out and used as a toothpick. For example U.S. Pat. No. 2,877,547 to Feaster shows a wooden stirring stick the size of a conventional tongue depressor, which has a line of perforation which delineates a toothpick portion which may be broken away from the main portion of the utensil by means of a bending force. Feaster also discloses wooden spoons and forks of a relatively large, usable size, which include similar perforated portions which can be broken out and used as a toothpick. The perforated toothpick portion is wholely confined within the body of the utensil handle and thus Feaster's structure cannot be applied to the plastic beverage stirrers discussed above which have a substantially smaller cross sectional dimension within which it would not be possible to form a wholely confined toothpick portion. In addition, the toothpick will not break away cleanly due to the selvage which bounds the two opposing sides of the toothpick. Finally, in the Feaster structure, only a single toothpick may be provided, so that if a user requires more than one toothpick, a second complete eating utensil must be wasted in the effort to secure a second toothpick.

OBJECTS OF THE INVENTION

It is therefore an object of the invention to provide a frangible toothpick structure incorporated in a relatively thin beverage stirrer.

It is another object of the invention to provide a frangible beverage stirrer which, when broken, produces two toothpicks.

It is still another object of the invention to provide a frangible beverage stirrer, which when broken will provide an improved toothpick.

It is yet another object of the invention to provide a frangible beverage stirrer which may be more easily broken into the plurality of toothpicks.

SUMMARY OF THE INVENTION

These and other objects, features and advantages of the invention are provided by the combination toothpick and beverage stirrer disclosed herein.

An improved frangible beverage stirrer is disclosed which is capable of being broken into two toothpicks. The utensil includes a handle portion having an upper surface and a lower surface with a relatively long dimension along an axis. A first end of the handle has a gripping surface and a second end of the handle opposite thereto has a spoon bowl or other appliance mounted thereon. The handle portion has a first straight diagonal groove in the upper surface thereof located between the first and second end and oriented at an angle with respect to the axis. A second straight diagonal groove parallel to and juxtaposed with the first groove, is in the lower surface of the handle. The handle is capable of being broken into two portions along the grooves by grasping the gripping surface and the spoon bowl and applying a torque along the axis, thereby forming two toothpicks with their respective pointed ends formed by the grooves.

DESCRIPTION OF THE FIGURES

These and other objects, features and advantages of the invention will be more fully appreciated with reference to the accompanying figures.

DISCUSSION OF THE PREFERRED EMBODIMENT

Figure 1:
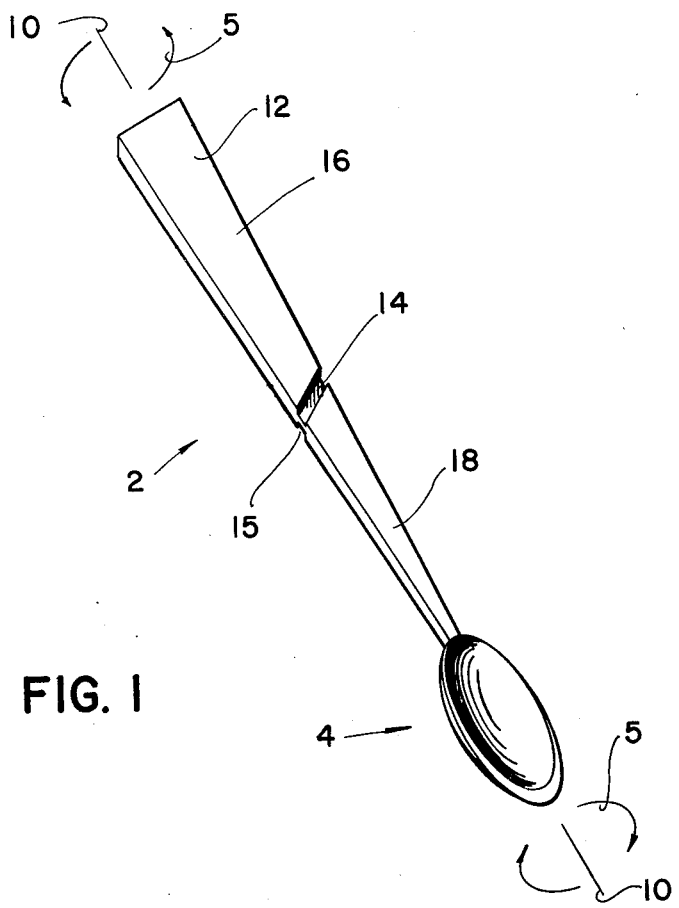
FIG. 1 shows an isometric view of the combination toothpick and beverage stirrer.

The improved frangible beverage stirrer is shown in overall view in FIG. 1. The beverage stirrer includes a narrow handle portion 2 having an upper surface 6 and the lower surface 8 with a relatively long dimension along an axis 10. In its preferred embodiment, the long dimension of the handle may be approximately 5 inches. The cross sectional dimension of the handle is approximately 1/16 of an inch at its narrowest point just above the spoon bowl portion 4 to which it is attached. In an alternate embodiment, a small olive fork utensil may be substituted for the spoon bowl 4. A first end of the handle 2 has a gripping surface 12 which is relatively broad in a transverse direction with respect to the axis 10, so as to enable the user to grip the handle at the end 12 with one hand and the bowl 4 with the other hand so as to impart a twisting torque 5 along the axis 10 of the utensil, to thereby break the utensil along the diagonal grooves 14 and 15.

Figure 2:
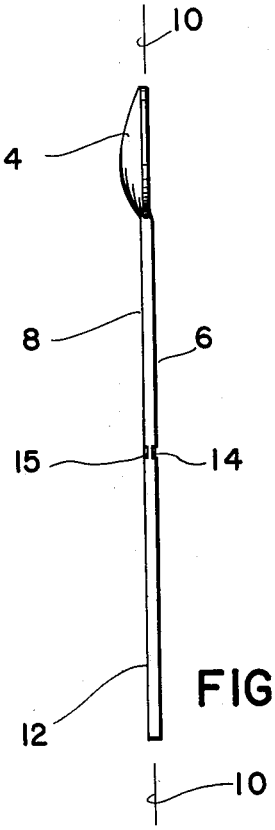
FIG. 2 shows a side view of the combination toothpick and beverage stirrer.

As is seen to better advantage in FIG. 2, the handle portion 2 has a first straight diagonal groove 14 in the upper surface 6 of the handle located approximately midway between the end 12 and the bowl 4. The diagonal groove 14 is oriented at an angle $\theta$ of approximately 20° with respect to the axis 10. A second straight diagonal groove 15 is parallel to and juxtaposed with the first groove 14, in the lower surface 8 of the handle 2.

Figure 3:
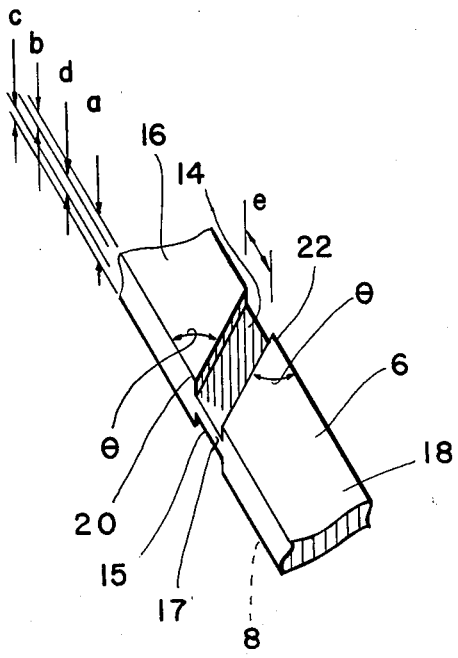
FIG. 3 shows a detailed isometric view of the grooves in the handle of the stirrer.

A more detailed view of the structure of the grooves 14 and 15 may be seen in FIG. 3. In its preferred embodiment, the thickness a of the handle 2 between its upper surface 6 and its lower surface 8 may be approximately 1/16 of an inch. In its preferred embodiment, the depth b of the groove 14 beneath the upper surface 6 may be approximately one fourth the thickness a of the handle, or 1/64 of an inch. Similarly, the depth c of the second groove 15 beneath the lower surface 8 may be approximately one fourth of the thickness a, or 1/64 of an inch. Thus, in its preferred embodiment, the thickness of the material 17 between the grooves 14 and 15 in the handle 2 will be approximately 1/32 of an inch. The width e of the grooves 14 and 15 may be approximately 1/64 of an inch. It has been found that for a handle 2 composed of injection molded poly-styrene plastic, these dimesnions will provide sufficient shear strength to the handle for its beverage stirring function while at the same time will permit the ready breakage thereof along the slots 14 and 15 when the twisting torque 5 is applied along the axis 10, thereby producing the desired toothpicks.

Figure 4:
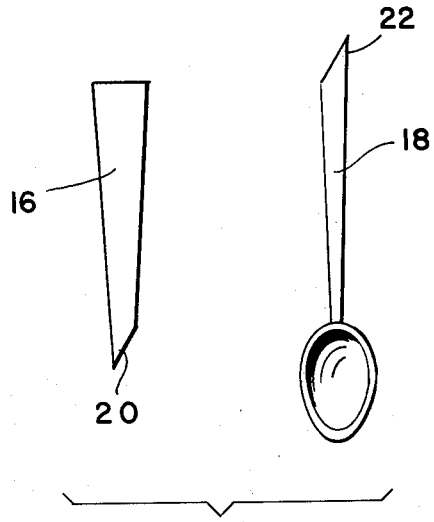
FIG. 4 is a frontal view of the invention showing how the two toothpick portions are formed after breaking the frangible beverage stirrer.

FIG. 4 illustrates the two toothpicks 16 and 18 which are produced by applying the twisting torque 5 along the axis 10 of the utensil shown in FIG. 1. The toothpick points 20 and 22 of the toothpicks 16 and 18, respectively, have a point angle of $\theta$ of 20° in the preferred embodiment. This point angle is uniform and well defined because of the clean break provided by the straight diagonal grooves 14 and 15 in the handle 2. The simple twisting torque 5 which breaks the toothpicks 16 and 18 apart, provides a uniformly clean break between the two toothpick portions.

In its preferred embodiment, the utensil is composed of a polymeric thermoplastic which may be formed by injection molding. Preferred compositions for the utensil include polystyrene, polyethylene, polypropylene, polyvinyl chloride, polycarbonate resins or polyester resins.

In its preferred embodiment, the utensil may be made from injection molded polystyrene, Polystyrene thermoplastics have generally excellent resistance to indoor environments. They can function continuously at temperatures of from minus 30° F. to above the boiling point of water. Most of the available formulations for polystyrene thermoplastic have a load-bearing design strength of 800 to 1500 psi in continuous use. In order to increase the heat resistance of polystyrene and maintain its moldability, the monomer may be copolymerized with various nitrogen-containing compounds such as acrylonitrile, fumeric nitrile, and vinyl carbazole. Pellets of the thermoplastic material are injection molded with standard screw equipment using the conventional technique of injecting the molten plastic into a cool mold.

An alternate method for preparing the utensil is to mold the beverage stirrer without the grooves 14 and 15 and then subsequently machine the grooves into the handle by means of conventional machining techniques.

The resulting article is an economical, convenient, easily manufactured beverage stirrer of improved design which incorporates a pair of uniformly contoured toothpicks.

Although a specific embodiment of the invention has been disclosed, it will be understood by those workers skilled in the art that minor changes may be made in the structure thereof without departing from the spirit and scope of the invention.

I claim:

1. An improved frangible beverage stirring utensil capable of being broken into toothpicks, comprising:

a first toothpick portion having a relatively long dimension along an axis, with a first end having a gripping surface and a second end opposite to said first end, having a terminal surface inclined at an angle with respect to said axis forming a pointed tip;

a second toothpick portion having a relatively long dimension along said axis, with a first end having a spoon bowl integrally formed thereon and a second end opposite to said first end thereof, having a terminal surface inclined with respect to said axis forming a pointed tip;

said terminal surface of said first toothpick portion being parallel with and frangibly mounted to said terminal surface of said second toothpick portion forming a diagonal groove therebetween;

whereby said first and second toothpick portions serve as a beverage stirrer when connected together at said diagonal groove and serve as two toothpicks when frangibly separated at said diagonal groove.

2. The utensil of claim 1, wherein said utensil is composed of a polymeric plastic.

3. The utensil of claim 2, wherein said polymeric plastic composition is selected from the group consisting of polystyrene, polyethylene, polypropylene, polyvinyl chloride, a polycarbonate and a polyester resin.

* * * * *